US006256794B1

(12) United States Patent
Erickson

(10) Patent No.: US 6,256,794 B1
(45) Date of Patent: Jul. 10, 2001

(54) FOLDABLE SUN HAT ASSEMBLY

(76) Inventor: Tomiko Erickson, 10100 E. Calusa Club Dr., Miami, FL (US) 33186

( * ) Notice: Subject to any disclaimer, the term of this patent is extended or adjusted under 35 U.S.C. 154(b) by 0 days.

(21) Appl. No.: 09/435,701

(22) Filed: Nov. 8, 1999

Related U.S. Application Data

(60) Provisional application No. 60/107,527, filed on Nov. 9, 1998.

(51) Int. Cl.[7] ..... A42B 1/00

(52) U.S. Cl. ..... 2/209.11; 2/171.03; 2/175.1; 224/577

(58) Field of Search ..... 2/172, 171.03, 2/175.1, 175.3, 175.4, 209.11, 209.13, 209.12; 224/577

(56) References Cited

U.S. PATENT DOCUMENTS

| | | | | |
|---|---|---|---|---|
| 2,684,483 | * | 7/1954 | Kwake | 2/171.03 |
| 4,096,590 | * | 6/1978 | Keshcok | 2/180 |
| 4,999,851 | * | 3/1991 | Hall | 2/180 |
| 5,367,706 | * | 11/1994 | Davidson | 2/4 |
| 5,664,257 | * | 9/1997 | Hall | 2/69 |
| 5,664,261 | * | 9/1997 | Lacy | 2/172 |
| 5,799,335 | * | 9/1998 | Ethier | 2/209.11 |
| 5,845,339 | * | 12/1998 | Ashley et al. | 2/195.6 |
| 5,857,219 | * | 1/1999 | Edmark | 2/182.2 |
| 5,950,241 | * | 9/1999 | Gomez | 2/172 |

* cited by examiner

*Primary Examiner*—John J. Calvert
*Assistant Examiner*—Katherine Moran
(74) *Attorney, Agent, or Firm*—Malloy & Malloy, P.A.

(57) ABSTRACT

A hat assembly capable of being repeatedly, easily and selectively oriented either in a compact, collapsed position for convenient storage and transport, or in an outwardly expanded position for wearing. The hat assembly includes a head engaging portion which at least partially encloses a portion of the head of a wearer, and an outwardly extending brim, both preferably made of a soft, flexible cloth material. The brim is structured to extend outwardly a significant distance from the head of the wearer so as to offer some protection to the wearer's face, neck and shoulders from the sun, by maintaining these areas in a shaded position. The hat assembly also includes a shaping frame in the form of a continuous, closed loop of flexible material secured to a outer periphery of the brim. In the expanded position, the hat assembly is defined by the shaping frame assuming a single substantially circular configuration and exerting a radially directed tensioning force on the brim so as to maintain it in a substantially planar orientation in surrounding relation to the wearer's head. The collapsed position is defined by twisting or other manipulation of the shaping frame to orient and dispose the shaping frame in a plurality of attached, substantially concentrically oriented loops with the material defining the brim and the head engaging portion disposed in folded over relation about the loops.

15 Claims, 5 Drawing Sheets

FOLDABLE SUN HAT ASSEMBLY

CLAIM OF PRIORITY

The present application is based on and a claim to priority is made under 35 U.S.C. Section 119(e) to provisional patent application currently pending in the U.S. Patent and Trademark Office having Ser. No. 60/107,527 and a filing date of Nov. 9, 1998.

BACKGROUND OF THE INVENTION

1. Field of the Invention

The present invention relates to a hat which is selectively positionable between a collapsed, stored position and an expanded position designed for wearing. In the expanded position, the hat is preferably structured to include an enlarged brim that extends sufficiently outward from the head of the wearer so as to offer protection against the sun's rays.

2. Description of the Related Art

The wearing of hats, especially by the female segment of the population has been popular for many years. This popularity has lead to a wide variety of hats being available in numerous sizes and configurations which are primarily dictated by style preferences. In addition to being dictated by style, certain hat designs are created from the stand point of functionality to the extent that certain hats are specifically designed to accomplish purposes such as warmth, protection from the sun, etc. Men's hats are also available in a wide variety of designs, but typically, are not as important in terms of making a fashion statement. Thus, men's hats are usually more visible in that they are often more casual, as evidenced by baseball caps, cowboy hats, and other sporting apparel.

One disadvantage associated with the design of various hat structures, regardless of whether they are intended for men or women, is the storage of the hat without folding or otherwise damaging it. For example, with respect to many fashionable hats, including some cowboy hats, storage often requires the use of relatively large, bulky "hat boxes" or other storage facilities which take up a great deal of room. Quite logically, it is difficult to transport hats stored in this manner. Consequently, the carrying of a hat, when it is not being worn, is generally considered to be somewhat bothersome, particularly with hats of larger sizes and/or of configurations designed to shade a wearer from the rays of the sun.

Some have strived to overcome the problem of how to store a hat without damaging it. For example, with respect to baseball caps, it is known to provide a pole-like structure with a plurality of clips disposed thereon, each of which is structured to receive the bill of the cap therein so as to permit easy storage and display of several baseball caps. As another example, foldable hats have been developed, one of which provides a rigid skeletal frame comprised of a number of "ribs," typically made of wood and carrying a common fabric covering, which ribs are all connected at one end at a central pivot point, about which individual ribs of the frame can be "fanned" to cause the hat to assume a wearable orientation or a folded orientation, as desired. In addition, foldable hats have been developed which are formed of a cloth material and which utilize a flexible hoop structured to act as a supporting frame for the material defining the hat, which hoop may be manipulated to cause the hat to assume what may be considered a collapsed position for storage.

However, it is believed that none of the structures known in the art for providing a foldable hat are suitable for being employed in hats that are particularly designed to offer some protection from the sun, namely, hats which have a substantially wide brim that extends outwardly a significant distance from the face and head of the wearer. As some of the more stylish hats often incorporate wide brims as well, a problem associated with known collapsible hat structures is the inability to satisfy certain styling demands.

Accordingly, there is a need in the art for an improved hat structure which is selectively positionable between a collapsed position for storage and an expanded position for wear, wherein the overall design and configuration of the hat meet certain modern day styling requirements and further, wherein the dimensions of the various portions of the hat are sufficient to provide adequate shade to the head and other portions of the wearer's body. Any such improved hat structure should also permit the hat to be easily carried from place to place.

SUMMARY OF THE INVENTION

The present invention is intended to provide a solution to the needs which remain in the art and in particular, is directed towards a hat assembly which can easily be disposed in either a collapsed position for storage and convenient portability or in an expanded position so that it can be worn, as desired. The collapsible hat assembly of the present invention includes a head engaging portion dimensioned and configured to be positioned on the wearer's head, an outwardly extending brim and a shaping frame. Preferably, both the head engaging portion and the outwardly extending brim are formed of a cloth material, which might include but which is not limited to cotton, silk, nylon, or a water resistant or even water proof material, and as might be dictated by the intended style or appearance of the hat when worn. The outwardly extending brim is preferably, but not necessarily, secured to the head engaging portion and extends outwardly therefrom a sufficient distance so that when in the expanded position, the brim will provide some protection from the sun's rays to the wearer's head and neck region. Also in a preferred embodiment, the shaping frame is secured to an outer peripheral region of the outwardly extending brim and is structured and disposed to cause the brim of the hat to assume a substantially planar configuration when in its expanded, operative position. Preferably, the shaping frame comprises a continuously configured, closed band formed of a material with sufficient flexibility so as to permit its being bent or folded about itself and thereby, to effect a collapsed position. Consequently, in the collapsed position, the overall dimension and configuration of the hat assembly are such as to allow it to be significantly smaller than when the hat assembly is in an expanded position for wearing. The pliability of the preferred soft, cloth material from which the head engaging portion and the outwardly extending brim are formed are such as to allow these structures to be folded upon themselves between and about a plurality of substantially or at least partially concentrically disposed loops, without creasing or causing fold lines to be formed therein.

If desired, the hat structure of the present invention may include at least one attachment member which may or may not be formed of an elastic material and which is disposed and structured to facilitate maintenance of the hat on the wearer's head which would be helpful, especially in windy conditions. As an additional alternative, a decorative band or like decorative structure may be mounted on the exterior of the hat assembly adjacent to the head engaging portion and when so positioned, the aforementioned attachment member or members may be considered a part of the decorative band and be disposed to depend downwardly from the brim, so as to engage the wearer of the hat, most probably beneath the chin area. However, it is to be emphasized that the at least one attachment member can be structured to be a part of the decorative band or independently thereof.

In another embodiment, the present invention is further directed to a casing for the hat assembly when it is disposed in the collapsed orientation. Preferably, the casing is formed from a soft cloth or cloth like material that is structured to have a generally round or circular configuration that is sized to closely correspond to the size of the hat assembly when in its collapsed position. The casing further includes an opening or passage preferably formed along a peripheral region thereof, which is of sufficient dimension to allow the hat assembly, when in its collapsed position, to pass therethrough for storage.

A primary object of the present invention is to provide a hat assembly which is structured to be readily positioned into either an expanded position for wearing or a collapsed position for storage, as desired, and which can be conveniently carried or otherwise transported when in the collapsed position.

Another primary object of the present invention is to provide a collapsible hat assembly which includes a brim portion that extends outwardly from the head of a wearer by a distance which is sufficient to provide some protection to the face and upper body portion of the wearer from the sun's rays, when the hat is in the expanded position and that will not interfere with the hat's assuming of the collapsed position.

It is also an object of the present invention to provide a collapsible hat assembly which is designed and conf igured to satisfy current styling objectives so as to be readily adaptable to a variety of wardrobe combinations, thereby rendering the overall design of the hat assembly more versatile.

Still another object of the present invention is to provide a collapsible hat assembly which includes at least one attachment members structured to keep the hat assembly generally on the head of the wearer when the hat is being worn.

Yet another important object of the present invention is to provide a collapsible hat assembly which is used in combination with a casing that is configured to retain the hat assembly when in its collapsed position, and to facilitate carrying thereof on the wearer's body, if desired, when the hat is not being worn.

An advantage of the hat assembly according to the present invention is that the shaping frame is structured to have sufficient flexibility as well as structural integrity to allow repeated, selective positioning of the hat assembly between a collapsed position for storage and an expanded position for wearing by exerting a minimal amount of force thereon to orient the hat assembly between the two positions.

These and other objects, features and advantages of the present invention will become more clear when the drawing as well as detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENTS

Figure 7:
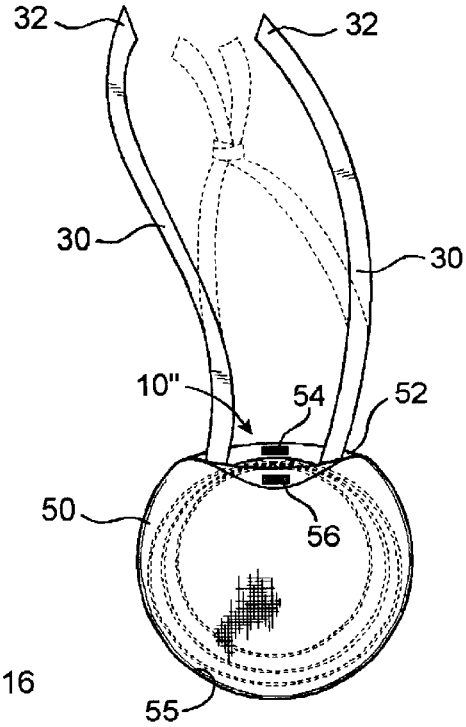
FIG. 7 is a perspective view of a casing for housing the hat assembly of the present invention when in its collapsed position.
Figure 9:
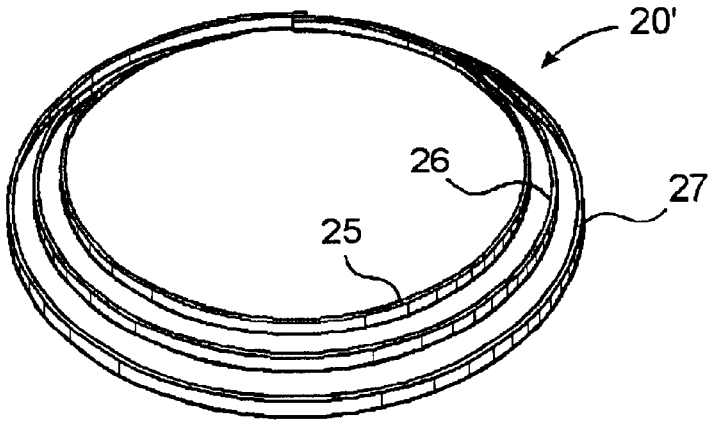
FIG. 9 is an illustration of the preferred shaping frame depicted in FIG. 4 and showing its collapsed position.
Figure 10:
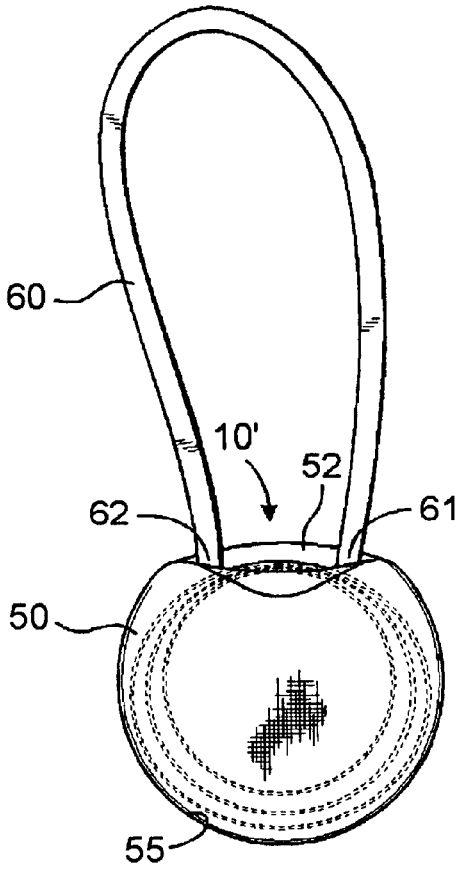
FIG. 10 is a perspective view of another embodiment of the present invention showing structure to facilitate carrying of the hat assembly when in its collapsed position.

As shown in the accompanying Figures, the present invention is primarily directed towards a hat assembly, generally indicated by reference numeral 10, which is structured to be selectively and repeatedly positioned in either an expanded position, for wearing as shown in FIGS. 1–3A or a collapsed position for storage, as represented in FIGS. 7, 9 and 10.

Figure 1:
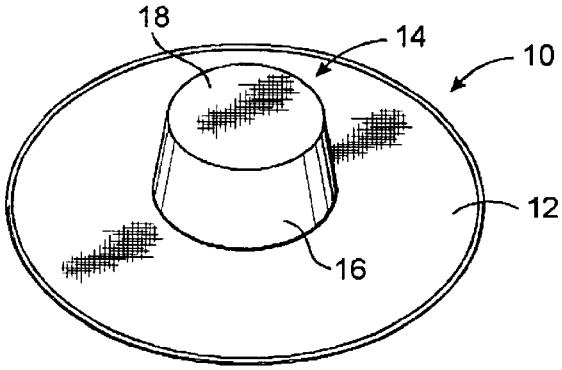
FIG. 1 is a perspective view of the preferred hat assembly according to the present invention in its expanded position.
Figure 2:
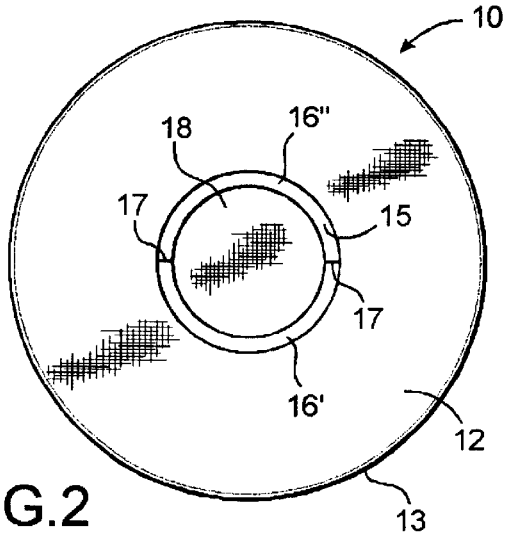
FIG. 2 is a bottom view of the preferred hat assembly illustrated in FIG. 1.

With reference to FIGS. 1 and 2, the hat assembly includes a head engaging portion 14 and outwardly extending brim 12. In the preferred embodiment, the outwardly extending brim 12 has an annular configuration which is at least partially defined by a central opening 15 and an outer, substantially circularly configured periphery 13. While the head engaging portion 14 may comprise a gripping band of elastic material sized to comfortably grip around the head, in a preferred embodiment, the head engaging portion 14 is made of cloth or cloth-like material, as is the outwardly extending brim 12, and extends upwardly from a surface of the brim 12, as shown in FIG. 1.

Figure 3:
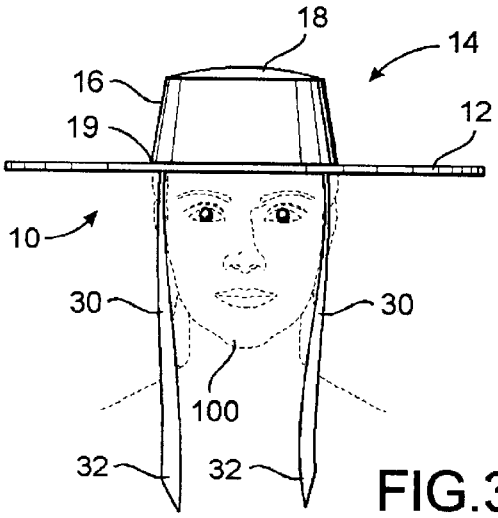
FIG. 3 is a front view of the preferred hat assembly shown in FIGS. 1 and 2, illustrating the hat being worn on a person, depicted in phantom.
Figure 8:
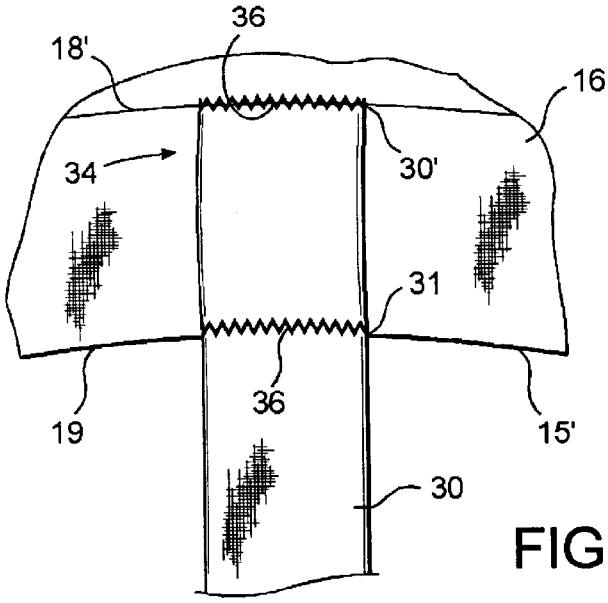
FIG. 8 is a detailed view showing interior portions of one embodiment of the head engaging portion of the hat assembly according to the present invention.

Referring now to FIGS. 3 and 8, in this preferred embodiment the head engaging portion 14 includes a side wall 16, ideally having an annular configuration as well, with an innermost end 19 thereof secured by way of stitching, sewing, adhesive or even hook and loop fasteners, about the circumference of the central opening 15, as at junction 15' of the brim 12, as best shown in FIG. 8. In this embodiment, the head engaging portion 14 is also structured to include a crown 18 that may also be secured by stitching, sewing, adhesive or even hook and loop fasteners, at the junction 18', to the outermost end of the side wall 16, as is also shown in FIG. 8. The side wall 16 may be formed from a single piece of material as shown in FIG. 1 or alternately from a plurality of side panels, such as 16' and 16" shown in FIG. 2, which are secured together at their opposite, correspondingly positioned, longitudinal ends 17. In any event, the outwardly extending brim 12, and in the preferred embodiments both the head engaging portion 14 including the side wall 16 and the crown 18, are formed from a flexible, soft, pliable material which may be silk, nylon, cotton, or a variety of other materials, including water proof or water resistant materials, which are capable of being folded upon itself, ideally without creasing or otherwise creating fold lines therein.

Figure 2A:
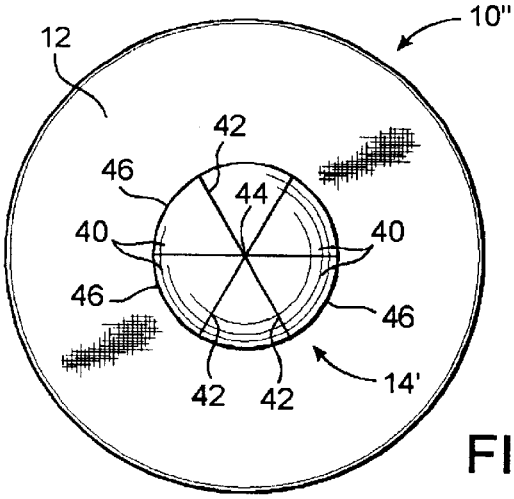
FIG. 2A is a top plan view of another embodiment of the hat assembly of the present invention.
Figure 2B:
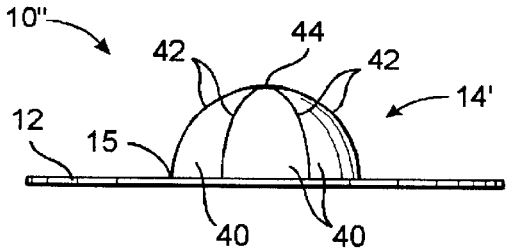
FIG. 2B is a front view of the embodiment of FIG. 2A.

Another preferred embodiment of the present invention is shown in FIGS. 2A and 2B wherein the hat assembly 10" comprises a head engaging portion 14' at least partially defined by a plurality side panels 40 which may vary in number and which are attached to one another at their correspondingly positioned peripheral edges 42 such that the plurality of side panels 40 form a continuous configuration which defines the head engaging portion 14' without a crown 18. In the absence of a crown 18 the side panels are of sufficient longitudinal dimension and are cooperatively configured so that an outer most end of each panels 40 is joined or interconnected at a common location 44 generally disposed at an outer most portion of the head engaging portion 14'. The opposite end of the side panels 40 are secured, as at 46, adjacent or contiguous to the central opening 15 formed in the brim 12.

Figure 3A:
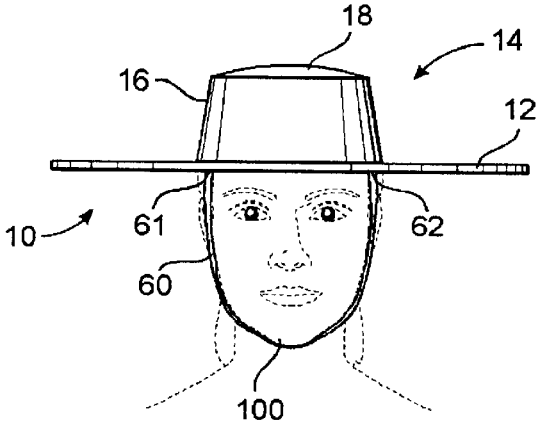
FIG. 3A is a front view of another embodiment of the hat assembly of the present invention illustrating the hat being worn on a person, depicted in phantom.
Figure 4:
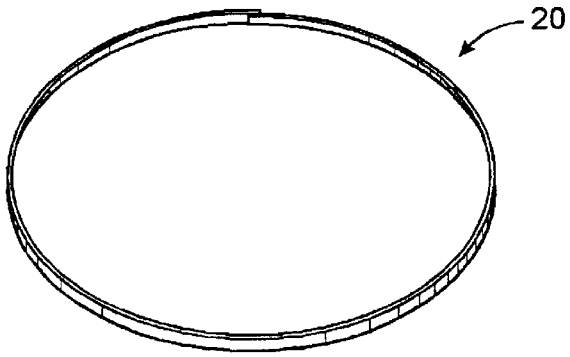
FIG. 4 is a perspective view of a shaping frame of the hat assembly according to the present invention.
Figure 5:
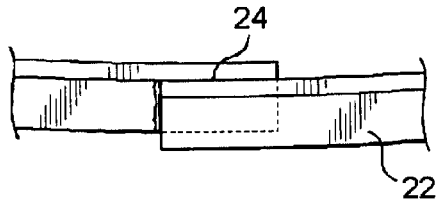
FIG. 5 is a detailed view in partial cutaway of another embodiment of the shaping frame illustrated in FIG. 4.

The hat assembly of the present invention also includes a shaping frame, generally indicated as 20, in FIG. 4. The shaping frame 20 is preferably formed to be of an integral, one piece construction comprising a flexible or at least partially resilient band 22. The shaping frame is preferably formed of a thin, flat strip of a non-corrosive, metallic material such as stainless steel or aluminum, or alternatively, may be formed from a thin strip of a resilient or flexible material plastic which is capable of being bent or folded upon itself without permanently forming any type of crease or imperfection along its length. With reference to FIG. 5, in order to form a band of one piece construction, opposite ends of the band 22 are preferably permanently and fixedly secured together, for example, by way of welding 24, in order to maintain the flexible material band 22 of the shaping frame 20 in a single, substantially circular configuration when it is disposed in its outwardly expanded orientation. When so disposed, the remainder of the hat assembly including the outwardly extending brim 12 and the head engaging portion 14 are in the expanded position for wearing, with preferably, the outwardly extending brim 12 assuming a substantially planar configuration, as best shown in FIGS. 1–3A. This planar configuration is assumed due in part to the pliability of the material from which the brim is formed and also from the radially directed tension placed on the brim by the shaping frame 20 when it has assumed the expanded, circular configuration shown in FIG. 4. Also with regard to the expanded position for wearing of the hat assembly 10, the head engaging portion 14 preferably extends away from the plane defined by the outwardly extending brim 12 in a substantially perpendicular orientation so as to engage or at least partially surround a portion of the head of the wearer, as represented in phantom lines in FIGS. 3 and 3A.

Figure 6:
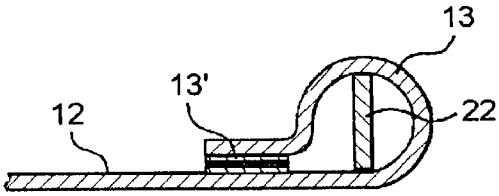
FIG. 6 is a detailed view in partial cutaway of a portion of the embodiment of FIGS. 1–3A.

An important feature of the shaping frame 20 is its ability to be repeatedly, selectively and easily positioned between the outwardly expanded position of FIG. 4 and the collapsed position of FIG. 9, wherein the shaping frame is designated generally as 20' when in its collapsed position. FIG. 9 shows the most preferred collapsed position which is at least partially defined by the shaping frame 20', disposed in a plurality of loops. The loops 25, 26 and 27 are preferably three in number and disposed in connected, and generally or at least partially concentric relation to one another. The positioning of the shaping frame into the collapsed position 20' is accomplished by exerting a twisting motion in opposite directions to diametrically opposed ends of the shaping frame 20 when in the position of FIG. 4. A folding of the shaping frame, while twisting it inwardly towards itself, serves to form in the preferred embodiment, the three generally concentrically disposed loops 25, 26 and 27. The collapsed position of the hat assembly 10 is further defined by the material forming the outwardly extending brim 12 as well as the head engaging portion 14 being folded about itself and between and over the three concentrically disposed loops 25, 26 and 27. For purposes of clarity, the material comprising the brim and head engaging portion are not shown in FIG. 9. The overall configuration and dimension of the hat assembly 10 when in the collapsed position, as at least partially represented in FIG. 9, is thereby significantly reduced and therefore, provides a compact assembly for convenient storage and transport purposes. To accomplish the selective positioning of the hat assembly 10 in the expanded position as shown in FIG. 1 and the collapsed position as shown at least partially in FIG. 9, the flexible material band 22 of the shaping frame 20 is preferably secured to an outer peripheral region, and most preferably to the periphery 13, of the outwardly extending brim 12. As shown in FIG. 6, the securing of the shaping frame to the outwardly extending brim may be accomplished during construction of the hat assembly, for instance, by folding the fabric or material which makes up the brim 12 at the peripheral edge or periphery 13 over itself and the shaping frame 20 disposed thereon and attaching that edge of the fabric or material onto either the inner or outer surface of the brim by way of stitching, sewing, glue or even hook and loop fasteners, indicated as 13'. A continuous channel is thereby formed in which the band 22 is positioned whether the band 22 is either in its expanded position of FIG. 4 or the collapsed position of FIG. 9.

In a most preferred embodiment, the hat assembly of the present invention includes a casing 50, shown in FIGS. 7 and 10, to be used in storing the hat assembly 10 when disposed in its collapsed position. More specifically, the casing 50 preferably but not necessarily, includes a generally round or circular configuration, generally like a small purse. The casing 50 is preferably defined by two panels of fabric material, or even a single panel or several panels of fabric material, but in any event will be ideally color or style coordinated to that of the hat assembly 10. The panels of fabric are preferably joined substantially and continuously about a common periphery 55 as by way of stitching, sewing, glue or even hook and loop fasteners. At least a portion of the joined peripheries 55 remains open, however, as at 52, so as to define a passage into and out of the interior of the casing 50. The opening 52 is dimensioned and configured to allow passage therethrough of the hat assembly 10 when in its collapsed position as shown in FIGS. 7 and 10. A closure, which may be in the form of a conventional hook and loop type fastener 54, 56, or snaps, buttons, etc. may be mounted adjacent the outer extremities of the opening 52 and structured to be removably attached to one another to facilitate closing and opening of the casing 50.

In the embodiments of FIGS. 3 and 8, the hat assembly includes at least one but as many as two elongated, outwardly extending attachment members 30. A proximal end of each attachment members 30 is represented in FIG. 8 and indicated as 34, wherein an extremity thereof, as at 30', is preferably fixedly attached, as by sewing, stitching, adhesive and/or hook and logs type fasteners, to the junction 18' between the crown 18 and the upper or outer end of side wall 16. In addition, each attachment member is preferably secured a spaced distance from the extremity 30', as at 31, at the junction 15' between the circumference 15 of the central opening of the brim 12 and the lower end 19 of the side wall 16. Sewing or stitching as at 36 serves to secure this inwardly spaced location of the attachment member 30, as shown in FIG. 8. By virtue of this connection to the interior surface of the head engaging portion 14, each of the attachment members 30 extend outwardly from the interior as shown in FIG. 3. Further, each of the two attachment members 30 are also of a sufficient length and include distal ends 32 which may or may not be tied together about the chin 100 or other portions of the head of the wearer, so as to maintain the hat assembly 10 in a preferred position when worn. The two attachment members 30 are also preferably structured and dimensioned to be disposable outwardly from casing 50 through opening or passage 52 when the hat assembly 10 is in the collapsed position 10' of FIG. 7. When the hat assembly 10' is retained within the purse-like casing 50, the two attachment members 30 may have their free or distal ends 32 disposed in either a separated relation, as shown in FIG. 7, or, removably coupled to one another, as by tieing as represented in phantom lines. The attachment members, when tied to one another about their free ends 32, define a sling like structure 33. This sling 33 may be used as a shoulder strap to support the hat assembly 10' while being retained within the purse like casing 50, in supported engagement about the shoulder or other portion of the wearer's body when being carried and not worn.

Another preferred embodiment of the present invention is shown in FIG. 3A wherein a single attachment member 60 has its opposite ends as at 61 and 62 secured as by sewing or any other applicable means, to the hat assembly 10 adjacent to the central opening 15, as described above. Further, the one attachment member 60 may be preferably formed of an elastic material of sufficient length and demonstrating sufficient elasticity so as to extend downwardly from an under portion of the outwardly extended brim 12 in surrounding relation generally about the chin of the wearer 100. When surrounding the chin of the wearer 100, the elastic characteristics of the one attachment member 60 may exert at least a minimal retaining force about the chin of the wearer 100 thereby further facilitating maintenance of the hat assembly 14 in it's preferred position on the head of the wearer, while being worn. When the one attachment member 60 is utilized as an alternate embodiment to the two attachment members disclosed in FIG. 7, the one attachment member 60 may also extend outwardly from the passage or opening 52 formed about the periphery of casing 50 when the remainder of the hat assembly is in it's collapsed position and retained within the interior of the casing 50, as shown in FIG. 10.

Figure 11:
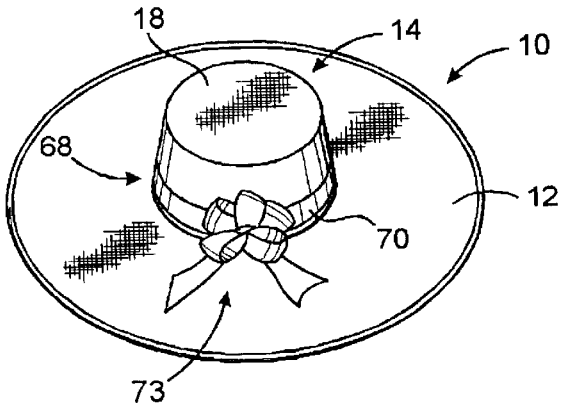
FIG. 11 is a perspective view of the embodiment of the hat assembly of the present invention as shown in FIG. 1 with an optional addition of a decorative structure attached thereto.
Figure 12:
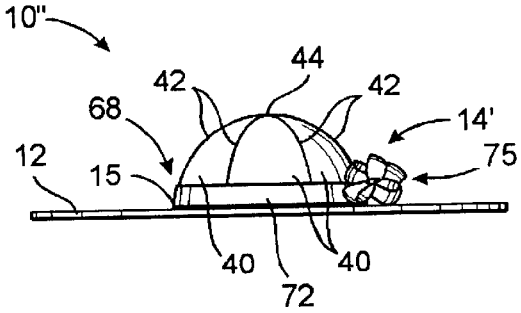
FIG. 12 is a front view of the embodiment of the hat assembly of the present invention as shown in FIG. 2B with the optional addition of a decorative structure attached thereto.
Figure 13:
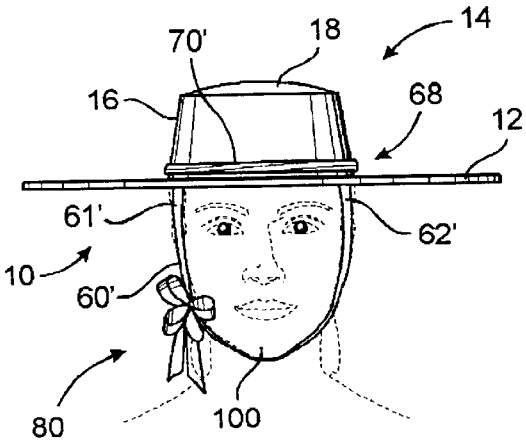
FIG. 13 is a front view of another embodiment of the decorative structure attached to the hat assembly of the present invention.
Figure 14:
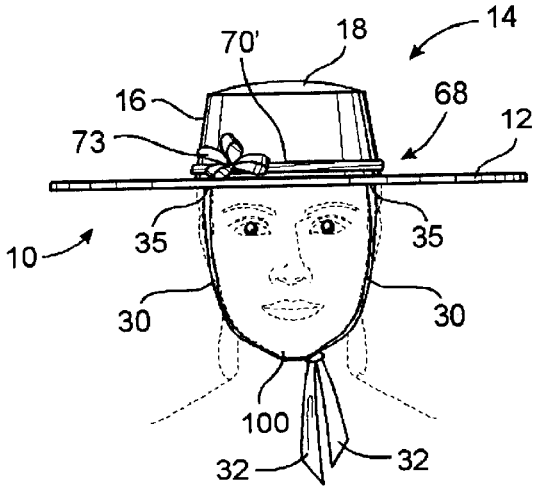
FIG. 14 is a front view of yet another embodiment of the decorative structure attached to the hat assembly of the present invention.

Additional embodiments of each of the hat assemblies 10 and/or 10" may include an optional, decorative structure generally indicated as 68 in FIGS. 11 though 17, wherein the decorative structure 68 is in the form of a decorative band 70 or 72 shown respectively in FIGS. 11 and 12. The band 70 or 72 may take a variety of configurations and dimensions and may have a substantially plain, un-interrupted configuration, as shown in FIG. 13 or alternatively may include at least one additional decorative member, which may be in the form of a bow 73 or flower 75. Naturally, the additional decorative member may assume a variety of other decorative configurations. More specifically in the embodiments of FIGS. 11 and 12, the decorative bands 70 and 72 are located above the rim 12 and adjacent to or in somewhat overlying relation to the outer surface of the sidewall 16 of the head engaging portion 14. Further, as shown in the various embodiments of FIGS. 11 through 17, the transverse dimension or thickness of the decorative structure 68 may vary from a relatively thin configuration, as shown in FIGS. 11, 13, and 14 and indicated as 70 and 70', to a relatively thick configuration as shown in FIGS. 15 through 17 and represented as 72'.

In addition, the decorative structure 68 may be mounted in such a manner as to either partially or completely surround the head engaging portion 14 adjacent to or in overlying relation to the outer surface of the side wall 16, as described above. Also, the material from which the decorative structure 68, including the decorative bands 70 and 72 and the one or more additional decorative members 73 or 75, are formed is of the type that can be folded upon itself without being damaged and without creasing or otherwise creating fold lines therein.

Further, the decorative structure in the form of decorative bands 70, 70' or 72, 72' may be mounted independently of or in combination with one or more attachment members. More specifically, as shown in FIGS. 14 and 16, the decorative structure 68 is defined by the decorative band 70' or 72' connected to or mounted in association with two, elongated attachment members 30 having their proximal ends 35 attached to the band 70' or 72' or otherwise associated therewith so as to extend downwardly from the brim 12, into retaining relation about the chin 100 of the wearer. This embodiment is of course similar to that shown in FIGS. 3 and 7, wherein the distal ends 32 of the attachment members 30 may be removably coupled to one another, as by tying or any other applicable means. Similarly, the attachment members 30 of the embodiments of FIGS. 14 and 16 may extend outwardly from the casing 50 so as to form a sling type structure to facilitate gripping or support on the wearer, in the manner shown in FIG. 7.

Figure 15:
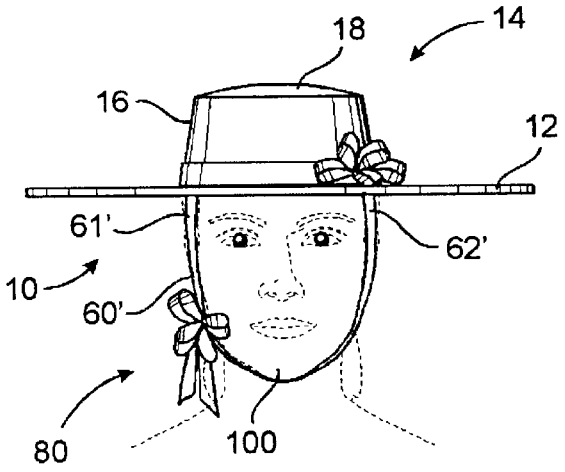
FIG. 15 is a front view of yet another embodiment of the decorative structure attached to the hat assembly of the present invention.
Figure 16:
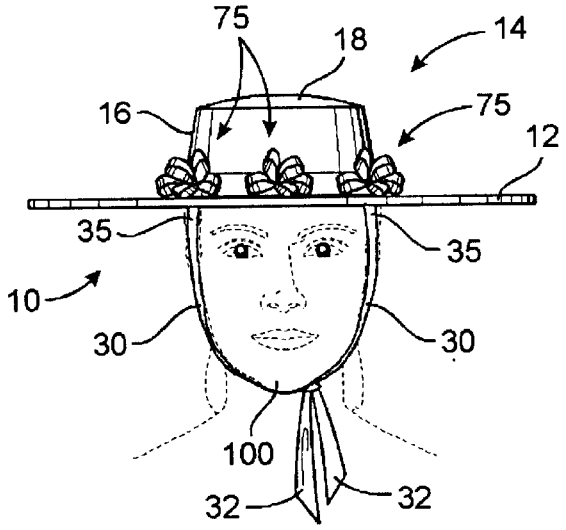
FIG. 16 is a front view of yet another embodiment of the decorative structure attached to the hat assembly of the present invention.
Figure 17:
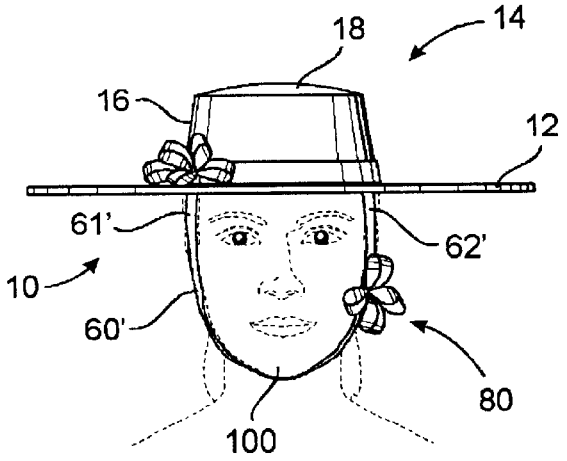
FIG. 17 is a front view of yet another embodiment of the decorative structure attached to the hat assembly of the present invention.

Alternatively, in the embodiments of FIGS. 13, 15 and 17, a single elongated elastic attachment member 60' has its opposite ends 61' and 62' secured to or otherwise associated with the decorative structure 68 generally and decorative band 70' or 72' specifically, so as to extend downwardly therefrom in underlying and at least partially retaining relation to the chin 100 of the wearer. This of course is similar to the embodiment of FIG. 3A of the hat assembly 10 of the present invention as described above.

It should be further noted, that regardless of the particular embodiment of the one or more attachment members utilized, yet an additional decorative member as at 80 may be secured to the single attachment member 60' or to one or both of the two attachment members 30, intermediate the ends thereof so as to add further decorative features to the hat assembly. The additional or auxiliary decorative member 80 may be in the form of a bow, flower or any other decorative configuration as desired by the wearer or designer of the hat assembly of the present invention.

Since many modifications, variations and changes in detail can be made to the described preferred embodiment of the invention, it is intended that all matters in the foregoing description and shown in the accompanying drawings be interpreted as illustrative and not in a limiting sense. By way of example only, the hat assembly of the present invention might be structured to include a head engaging portion that does not fully engage the head of the wearer, and that variation would be within the spirit of the present invention. Thus, the scope of the invention should be determined by the appended claims and their legal equivalents.

Now that the invention has been described,

What is claimed is:

1. A hat assembly designed to be selectively disposed in either a collapsed position or an expanded position, said assembly comprising:

a) a head engaging portion including a side wall and a crown secured to an outer end of said side wall, b) a brim having a substantially annular configuration at least partially defined by a central opening and an outer periphery having a continuous, substantially circular configuration, c) said side wall having an inner end being of substantially equal dimension as a circumference of said central opening; said inner end being secured continuously to said circumference along mutual lengths thereof, d) a shaping frame including an elongated, flexible material member secured to an outer periphery of said brim along the entire length of said shaping frame, e) said expanded position defined by said shaping frame oriented in a continuous, circular configuration and said brim assuming a substantially planar configuration oriented coplanar to said shaping frame, f) said collapsed position defined by said shaping frame oriented in a plurality of interconnected, substantially concentrically disposed loops and said brim and head engaging portion disposed in folded over relation to one another about and between said plurality of loops, g) a casing dimensioned and configured for surrounding containment of at least a majority of said hat assembly when in said collapsed position, and h) at least one attachment member having an elongated configuration extendable outwardly from said casing when said hat assembly is in said collapsed position and being structured for support of a remainder of said hat assembly by the wearer when said hat assembly is disposed within said casing.

2. An assembly as in claim 1 wherein said shaping frame is disposed and structured to exert a radially directed tensioning force on said brim so as to maintain said brim in said planar configuration when said hat assembly is in said expanded position.

3. An assembly as in claim 1 wherein said head engaging portion and said brim are formed of a common, soft, pliable material.

4. An assembly as in claim 1 wherein said one attachment member comprises a sufficient length to be removably positioned about the chin of the wearer.

5. An assembly as in claim 1 wherein said one attachment member is at least partially formed of an elastic material and is structured and dimensioned to extend about the chin of the wearer and exert at least a minimal retaining force thereon.

6. An assembly as in claim 1 wherein said casing includes an opening dimensioned and configured to allow passage therethrough of said head engaging portion and said brim when said hat assembly is in said collapsed position; said one attachment member extendable outwardly from said opening for support of said casing and a remainder of said hat assembly enclosed within said casing.

7. An assembly as in claim 6 wherein said casing further includes a closure mounted adjacent said opening and structured to selectively maintain said opening in at least a partially closed position.

8. A hat assembly designed to be selectively disposed in either a collapsed position or an expanded position, said assembly comprising:

a) a head engaging portion dimensioned and configured to enclose at least a portion of a wearer's head when said hat assembly is in said expanded position and including a side wall, b) a brim having a substantially annular configuration at least partially defined by a central opening and an outer periphery having a continuous, substantially circular configuration, c) said side wall extendable outwardly from said brim when said hat assembly is in said expanded position and having an inner end secured continuously about a circumference of said central opening, d) a shaping frame secured to said outer periphery of said brim and including an elongated member of flexible material having an integral one piece construction, e) said expanded position defined by said shaping frame oriented in a continuous, circular configuration and said brim assuming a substantially planar configuration oriented coplanar to said shaping frame, f) said collapsed position defined by said shaping frame oriented in a plurality of interconnected, substantially concentrically disposed loops and said brim and said head engaging portion disposed in folded over relation to one another about and between said plurality of loops, and g) a casing dimensioned and configured for surrounding containment of at least a majority of said hat assembly when in said collapsed position, said casing including an opening dimensioned and configured to allow passage of said head engaging portion and said brim therethrough when said hat assembly is in said collapsed position.

9. An assembly as in claim 8 further comprising at least one attachment member having an elongated configuration of sufficient length to be removably positioned about the chin of the wearer and terminating in opposite ends, each of said opposite ends of said one attachment member secured adjacent said head engaging portion.

10. An assembly as in claim 9 wherein said one attachment member is at least partially formed of an elastic material and is structured and dimensioned to extend about the chin of the wearer and exert at least a minimal retaining force thereon.

11. An assembly as in claim 8 wherein said side wall comprises a plurality of side panels interconnected in adjacent relation to one another and collectively disposed and configured to enclose at least a portion of the users head when said hat assembly is in said expanded position; said plurality of side panels each having one end interconnected to one another at a common location and an opposite end secured contiguous to said central opening.

12. A hat assembly as recited in claim 8 further comprising at least two attachment members each having an elongated configuration terminating in a proximal end and a distal end, said proximal end of each attachment member secured to an interior of said head engaging portion and said distal end of each member normally positioned outwardly from said brim and said head engaging portion to define a free end thereof.

13. A hat assembly as recited in claim 12 wherein said proximal end of each of said attachment members is secured to an interior of said side wall at a junction of said side wall and said central opening.

14. A hat assembly as recited in claim 12 wherein said attachment members are of a sufficient length for removable coupling to one another generally about the chin of the wearer.

15. A hat assembly as recited in claim 12 wherein said attachment members are of a sufficient length to be removably coupled together generally adjacent said distal ends thereof and cooperatively structured for supporting a remainder of the hat assembly on the wearer when in a collapsed position.

* * * * *